US006694985B1

(12) United States Patent
Kim

(10) Patent No.: US 6,694,985 B1
(45) Date of Patent: Feb. 24, 2004

(54) PROCESS FOR LOWERING NICOTINE CONTENTS IN TOBACCO

(76) Inventor: In-Jae Kim, 18/5, 674-2, Yuksam-Dong, Kangnam-Ku, 135-915 Seoul (KR)

( * ) Notice: Subject to any disclaimer, the term of this patent is extended or adjusted under 35 U.S.C. 154(b) by 0 days.

(21) Appl. No.: 09/979,092

(22) PCT Filed: May 16, 2000

(86) PCT No.: PCT/KR00/00474

§ 371 (c)(1),
(2), (4) Date: Jan. 16, 2002

(87) PCT Pub. No.: WO00/69289

PCT Pub. Date: Nov. 23, 2000

(30) Foreign Application Priority Data

May 17, 1999 (KR) ..... 1999-17566
Feb. 10, 2000 (KR) ..... 2000-6179

(51) Int. Cl.[7] ..... A24B 15/00
(52) U.S. Cl. ..... 131/309; 131/310; 131/200; 131/290

(58) Field of Search ..... 131/290, 300, 131/309, 310

(56) References Cited

U.S. PATENT DOCUMENTS 3,863,645 A * 2/1975 Tien et al. ..... 131/352
4,848,373 A * 7/1989 Lenkey ..... 131/297

FOREIGN PATENT DOCUMENTS

JP 1-289476 * 11/1989

* cited by examiner

*Primary Examiner*—Dionne A. Walls
(74) *Attorney, Agent, or Firm*—Arent Fox Kintner Plotkin & Kahn, PLLC

(57) ABSTRACT

A process for lowering toxic substance including nicotine in tobacco is disclosed. The process of the present invention comprises treating tobacco leaves with water, alcoholic drink, or a mixture thereof. It is also possible to lower the nicotine contents of tobacco by using licorice vinegar. Loess water, licorice, black beans, other vinegar than licorice vinegar, or salt can be added or as a mixture thereof in order to maintain the unique flavor and taste of tobacco.

4 Claims, No Drawings

PROCESS FOR LOWERING NICOTINE CONTENTS IN TOBACCO

TECHNICAL FIELD

The present invention relates to a process for lowering nicotine contents in tobacco, in particular to a process for lowering nicotine, tar and additional toxic components in tobacco leaves by using Chinese medicine.

BACKGROUND ART

Since tobacco has been introduced from Native Americans to Europeans according to discovery of America continent by Columbus, the tobacco has been rapidly spread around the world. Once the tobacco was used for a psychical cure and was used for ceremonies such as burning incense, but habituation and toxicity of the tobacco are gradually known to the general public.

The toxicity of the tobacco on body and mind is well known. In particular, women smokers increase in recent years and an age group of smokers lowers gradually, considering the trend the toxicity of the tobacco on individuals and over all society can not be ignored any more.

The tobacco comprises about seven thousands of particulate and gaseous materials, among them about thirty materials are lethal to a human body such as a benzopyrene which has been found as an inducer of cancer, tar, carbon monoxide which exhausts oxygen in blood, a material inducing bronchitis and a nicotine having strong addiction. Among them the nicotine is a strongly addictive material as same as a narcotic drug including toxicity of itself, on that ground a plurality of smokers can not quit smoking due to nicotine toxication. The nicotine was distinguished from cocaine in the past due to a misunderstanding that the nicotine is not habit-forming material, but now it has been identified as the habit-forming material. FDA (Food and Drug Administration) of U.S.A. officially defines the tobacco as a toxic material, and recently the WHO (World Health Organization) declares a war against the tobacco.

The nicotine representing the toxicity of the tobacco is a colorless alkaloid, it induces vomits, dizziness, headaches, it is not destroyed during smoking, but is inhaled in a lung, and reaches a brain in seven seconds. The nicotine is not only habit-forming, but also very toxic, its lethal dosage of an adult is 1 mg per 1 Kg of an adult weight. Accordingly if an adult with the body weight of 60 Kg takes 60 mg of the nicotine in the blood at once, the adult will be killed. Given that the average nicotine content of a piece of cigarette is 10~20 mg, chewing 3~6 pieces of cigarette will lead to a death. Considering that the lethal dosage of a potassium cyanide is 150 mg/60 kg of adult, the toxicity of the nicotine is as high as two or three times of that of potassium cyanide. Thus, the nicotine is a deadly poisonous material.

Accordingly, low-nicotine cigarettes were developed a lot and even other herbs were used as substitutes of the tobacco, however they were not satisfying to lower contents of the nicotine. In the latter case, they do not have the nicotine, but can not provide any flavor or taste of the tobacco either.

SUMMARY OF THE INVENTION

Therefore, an object of the present invention is to provide a process for lowering nicotine and other toxic contents in tobacco.

Another object of the present invention is to provide the process for lowering the nicotine and other toxic contents in the tobacco, and preserving flavor of the tobacco of its own.

DETAILED DESCRIPTION OF THE INVENTION

The prefer embodiments of the present invention will now be described.

The preferred embodiment of the present invention can lower contents of toxic materials such as a nicotine in tobacco leaves by dipping the tobacco leaves in water, alcoholic drink or mixture of water and alcoholic drink or spraying the said mixture on the tobacco leaves and then steaming and drying the tobacco leaves. The process can be repeated up to nine times, and the efficiency of lowering contents of the toxic materials such as the nicotine In tobacco leaves improves in proportion to repetition times.

In addition, the other embodiment of the present invention can lower contents of the toxic materials such as the nicotine in tobacco leaves by dipping the tobacco leaves in mixed liquid of loess water and licorice vinegar. Its nicotine lowering mechanism is not understood dearly, but it is deemed that a synergy effect occurs by combination of unique acetic acid fermentation of the licorice vinegar and alcohol fermentation of the alcoholic drink.

In addition, the loess having clarifing, detoxication and far-infrared radiation emitting effect, vinegar having detoxication effect on various toxins, black beans, other vinegars than licorice vinegar and salt can be added alone or in a mixed form in order to improve the detoxication effects and to secure the inherent taste and flavor of the tobacco. Herein, the licorice, black beans, salt or vinegar is added for preserving the taste and flavor of the tobacco, rather than for lowering the toxic contents such as the nicotine, and such effect is sufficient with a very small amount.

Type and concentration of alcohol in the alcoholic drinks used in the present invention are not critical. Korea soju, kaoliang liquor, Korea coarse liquor (called Tak-ju or Maggoli), Korea refined rice liquor, beer, whisky, vodka, wine etc. can be used alone or in a mixed state. However, it is advisable for using Korea coarse liquor in the aspects of the price and effect.

When a mixture of the alcoholic drink and water is used as a processing liquid, it is advisable for the mixture to contain alcoholic drink and water in the volume ratio of 1:1~5.

In an Embodiment 1 of the present invention explained below, water, alcohol liquid or mixture of them can be heated optionally prior to a steaming step, the heating temperature of the mixture is between 30° C.~150° C. The nicotine lowering effect can be improved further when the processing liquid is heated. Herein, loess water, licorice, black bean, salt or vinegar can be added before or after the heating step. And, it is also possible to heat the tobacco leaves as while soaked in the processing liquid. It is of course possible to treat the tobacco leaves with the heated processing liquid.

In additon, steaming step can be performed with either of weak fire or strong fire, and the steaming time depends on the amount of the tobacco leaves to be treated and the intensity of heating.

The licorice vinegar used In Embodiment 2 of the present invention explained below is produced by mixing the licorice with water, heating said mixture at 100° C.~150° C. to obtain the licorice broth, non-distilled alcoholic liquor such as Korea coarse liquor and persimmon vinegar are added into the licorice broth, and then conducting fermentation at least 3 days. In producing the licorice vinegar of the present invention, licorice 100 parts by volume, water 500~1000 parts by volume, non-distilled alcoholic drink 300~500 parts by volume, and persimmon vinegar 50~100 parts by volume can be used.

The process for lowering nicotine contents in tobacco of the present invention will be more clearly understood with reference to the following examples.

WORKING EXAMPLES

Embodiment 1

(1) Loess, licorice and black bean are soaked in water and are heated at 30° C.~100° C. so as to obtain broth. Herein, the ratio of the loess, licorice and black bean to water are each 5 g~300 g, 5 g~300 g and 100 g~200 g per 5 L of water. Tobacco leaves are dipped in the broth for six hours~twenty four hours.

(2) The tobacco leaves treated by the above dipping step are dried in the shade for a day, and the alcoholic drink selected among the Korea soju, kaoliang liquor, Korea coarse liquor, Korea refined rice liquor, beer, whisky, vodka or wine is sprayed on the tobacco leaves.

(3) The tobacco leaves evenly wet by the alcoholic drink are put into a rice steamer (container having holes in its bottom), and then the mixture of alcoholic drink and water (in the volume ratio of 1:1~5) and small amount of salt and vinegar are put into a separate container which is located below the above rice steamer and and the tobacco leaves are steamed for thirty minutes~two hours by steam of the mixture.

(4) The steamed tobacco leaves are dried again for a day, and the step (3) can be repeated two times~nine times if required. The nicotine lowering effect improves in proportion to the repetition times.

The order of the above steps can be changed and can be performed in combination. For example, it is possible to combine (1) step with (2) step. That is, the tobacco leaves can be dipped in the mixture of alcoholic drink, loess, licorice, black bean, water, vinegar or salt and then heated and dried, or it is also possible to heat the above mixture of alcoholic drink, loess, licorice, black bean, water, vinegar or salt in advance and then the tobacco leaves are dipped therein and dried. Besides, it is also possible to dip the tobacco leaves in the broth and dry, or spray the broth on the tobacco leaves, steam using the rice steamer, and dry the tobacco leaves.

Example 1

10 g of Loess, 15 g of licorice and 50 g of black bean 50 were mixed with 5 L of water, the obtained mixture was heated for six hours so as to obtain broth, and 600 g of tobacco leaves were dipped in the broth for twelve hours. After that, the tobacco leaves were naturally dried at shade for a day, and the Korea coarse liquor was evenly sprayed on the tobacco leaves. The tobacco leaves thus treated were put into a rice steamer. A mixture of the Korea coarse liquor and water in the volume ratio of 1:3 and small amount of vinegar and salt were put below the rice steamer. The tobacco leaves were steamed by steams of the mixture for an hour, and were dried for one day.

Example 2

600 g of Tobacco leaves were dipped in 5 L of mixture of water and the Korea coarse liquor (volume ratio of 1:3) for twelve hours, the tobacco leaves were steamed in a rice steamer by the steams of the mixture, and were dried. These steps were repeated three times. In the comparison with the Example 1, the loess, licorice, black bean, vinegar and salt were not added in the above mixture.

Embodiment 2

Water, alcoholic drink, licorice vinegar are mixed in the volume ratio of 100:5~15:0.1~5. It is preferred that the above ratio is 100:10:1. For example, first, alcoholic drink and licorice vinegar are mixed in the volume ratio of 10:1 and this mixture is ripened for a day. To this ripened mixture, 10 times volume of water of room temperature is added and then the tobacco leaves are dipped in the mixture. In a dipping step, the container is closed by using a lid in order to accelerate fermentation as well as to prevent the invasion of sundry bacteria. The dipping time is in the range of twenty four hours~seventy two hours, and the dipping temperature is in the range of 18° C.~30° C. When the dipping time is less than twenty four hours, the fermenting effect is not sufficient, and when the dipping time is more than seventy two hours, the tobacco leaves would be over-ripened.

Altenatively, water, alcoholic drink, licorice vinegar are mixed altogether in the mixing ratio by volume of 100:10:1, the tobacco leaves are fully dipped in the above mixture, the container is closed with a lid, and tobacco leaves are fermented in the temperature range of 18° C.~30° C. for twenty four hours~seventy two hours.

It was found that there is not much difference between the results of the former and latter.

In the case of adding loess, licorice, black bean, salt and vinegar in the mixture, they can be dipped with the tobacco leaves in the processing mixture.

Example 3

1 L of licorice vinegar was mixed with 10 L of Korea coarse liquor, and the mixture was ripened for a day. 10 times of water having room temperature was added to the above ripened mixture, and 600 g of the tobacco leaves were dipped in the mixture and were fermented for twenty four hours at 20° C. while the container was closed. After the fermenting, the tobacco leaves were dried well.

Example 4

100 L of Water, 10 L of Korea coarse alcoholic drink and 1 L of licorice vinegar 1 L well mixed, and tobacco leaves were dipped in the above mixture and then fermented for two days at 25° C. with the container closed.

Example 5

Tobacco leaves were treated in the same manner as in Example 3 except that loess, licorice and black beans were added further in the processing mixture.

In order to measure nicotine contents in the tobacco leaves treated by Embodiment 1 or Embodiment 3, an analysis was entrusted to the Advance Analysis Center of KIST (Korea Institute of Science and Technology). The test was performed using a gas chromatography, and result of the test is illustrated in Table 1. Sample 1 is ordinary tobacco leaves without any treatment, sample 2 is the tobacco leaves treated by the procedure of Example 1 of the present invention, sample 3 is the tobacco leaves treated by the procedure of Example 2 of the present invention, sample 4 is the tobacco leaves treated by the procedure of Example 3 of the present invention.

TABLE 1

| Sample Number | Nicotine Contents (wt. %) |
|---|---|
| Sample 1 | 0.735 |
| Sample 2 | 0.040 |
| Sample 3 | 0.053 |
| Sample 4 | 0.33 |

As shown in Table 1, the nicotine contents of the tobacco leaves of Samples 2 and 3 treated by the procedure of Embodiment 1 of the present invention significantly decreased to 5.4% and 7.2% of that of the non-treated tobacco leaves of Sample 1, respectively. It was further noted that Sample 2 retained the inherent taste and flavor of tobacco leaves when they were smoked with a pipe. However, the taste and flavor of the tobacco leaves of Sample 3 decreased a little in the comparison with the tobacco leaves of Sample 2.

Meanwhile, the nicotine contents of the tobacco leaves of Sample 4 treated by the procedure of Embodiment 2 of the present invention decreased less than half of the nicotine contents of the ordinary tobacco leaves. In the case that the process of the Embodiment 2 is performed one more time, the nicotine contents decreased further, but when the process is performed more than three times, the taste of the tobacco leaves lowers. Accordingly it is preferred to carry out the process one or two times. In addition, the taste and flavor of the tobacco leaves treated as in Example 3 were as same as the taste and flavor of the ordinary tobacco leaves or those of Sample 2.

The aforementioned results show that the nicotine lowering efficiency of Embodiment 1 is better than that of Embodiment 2 which uses licorice vinegar. Although Embodiment 2 is inferior to Embodiment 1 in the lowering efficacy of toxic substances such as nicotine, it should be noted that the process of the Embodiment 2 can still lower the nicotine contents of the tobacco leaves less than 50% of the ordinary tobacco leaves by simple procedure and thus, the efficiency of Embodiment 2 is as good as that of the Detailed Embodiment 2.

In the meantime, although the contents of tar was not directly measured in the test, it was assumed that the procedure of Examples 1 to 3 of the present invention can remove tar almost completely as well, in view of the fact that the pipes used in smoking of the tobacco leaves of the Sample 2~4 were clean as same as before smoking, while dark black impurities were found around the inner vent hole of the pipe used in smoking of the tobacco leaves of the Sample 1 as puffing frequency increased.

INDUSTRIAL ACCABILITY

A process for lowering nicotine contents in tobacco of the present invention can dramatically lower toxic substances such as nicotine in tobacco leaves at least less than 50%, at greatly as less than 10% of the ordinary tobacco leaves. Further, by additional processing procedure of the present Invention, it is also possible to preserve the inherent flavor of the tobacco leaves without any loss. Thus, according to the present invention, it is possible to prevent various disease directly caused by the tobacco, helping long time smokers quit smoking, and preventing beginner smokers from becoming nicotine addict, while still enjoying the inherent taste and flavor of the tobacco leaves.

What is claimed is:

1. A process for lowering nicotine content in tobacco comprising the steps of:

mixing Korean coarse liquor, licorice vinegar and water;

dipping tobacco leaves in the mixture; and fermenting the tobacco leaves in a temperature range of 18° C.~30° C. for 24~72 hours.

2. The process according to claim 1, wherein the mixture contains water, Korean coarse liquor and licorice vinegar in the volume ratio of 100:5~15:0.1~5.

3. The process according to any one of claim 1 or 2 wherein Korean coarse liquor and licorice vinegar are mixed and ripened first and then mixed with water.

4. The process according to claims 1 or 2 wherein the mixture contains further loess, licorice, black beans, vinegar or salt.

* * * * *